US010683189B2

(12) United States Patent
Saraswat et al.

(10) Patent No.: US 10,683,189 B2
(45) Date of Patent: Jun. 16, 2020

(54) CONTEXTUAL AWARENESS-BASED ELEVATOR MANAGEMENT

(71) Applicant: Intel Corporation, Santa Clara, CA (US)

(72) Inventors: Ruchir Saraswat, Swindon (GB); Nicholas P. Cowley, Wroughton (GB); Richard J. Goldman, Cirencester (GB)

(73) Assignee: Intel Corporation, Santa Clara, CA (US)

( * ) Notice: Subject to any disclaimer, the term of this patent is extended or adjusted under 35 U.S.C. 154(b) by 728 days.

(21) Appl. No.: 15/190,848

(22) Filed: Jun. 23, 2016

(65) Prior Publication Data

US 2017/0369275 A1 Dec. 28, 2017

(51) Int. Cl.

| | |
|---|---|
| ***B66B 1/18*** | (2006.01) |
| ***B66B 1/28*** | (2006.01) |
| ***B66B 1/34*** | (2006.01) |

(52) U.S. Cl.

CPC ..... *B66B 1/28* (2013.01); *B66B 1/3407* (2013.01); *B66B 2201/20* (2013.01); *B66B 2201/243* (2013.01); *B66B 2201/40* (2013.01); *B66B 2201/402* (2013.01)

(58) Field of Classification Search

CPC ..... B66B 1/28; B66B 1/3407; B66B 2201/20; B66B 2201/243; B66B 2201/40; B66B 2201/402

USPC ..... 187/247, 278, 380–389, 391, 392, 393

See application file for complete search history.

(56) References Cited

U.S. PATENT DOCUMENTS

| | | | | |
|---|---|---|---|---|
| 5,031,728 | A * | 7/1991 | Amano | B66B 1/2408 187/382 |
| 5,168,136 | A | 12/1992 | Thangavelu et al. | |
| 5,354,957 | A * | 10/1994 | Robertson | B66B 1/2408 187/247 |
| 5,612,519 | A * | 3/1997 | Chenais | B66B 1/2458 187/380 |

(Continued)

FOREIGN PATENT DOCUMENTS

| | | |
|---|---|---|
| JP | 2006-506297 A | 2/2006 |
| JP | 2006-193296 A | 7/2006 |

OTHER PUBLICATIONS

International Search Report and Written Opinion dated Aug. 18, 2017 for International Application No. PCT/US2017/032085, 13 pages.

(Continued)

*Primary Examiner* — Anthony J Salata

(74) *Attorney, Agent, or Firm* — Schwabe, Williamson & Wyatt, P.C.

(57) ABSTRACT

Processes, apparatuses, and systems associated with usage and contextual-based elevator operations management that have the capability to learn and to constantly adapt to usage patterns on a temporal basis through continuous monitoring of elevator journeys. An elevator journey may include a start and termination floor for an individual. Elevator journey data may be used to predict patterns of usage and maybe used, for example, to optimize the number of elevators operational at any time, determine the optimal parking position of each elevator, and/or determine an efficient allocation of elevators to groups or related floors.

19 Claims, 5 Drawing Sheets

(56) References Cited

U.S. PATENT DOCUMENTS 5,616,896 A * 4/1997 Kontturi ..... B66B 1/2458 187/382
5,841,084 A * 11/1998 Thangavelu ..... B66B 1/2458 187/382
6,315,082 B2 * 11/2001 Hikita ..... B66B 1/2458 187/247
7,014,015 B2 * 3/2006 Nikovski ..... B66B 1/2458 187/247
7,594,564 B2 * 9/2009 Siikonen ..... B66B 5/021 187/290
7,621,378 B2 * 11/2009 Kawai ..... B66B 5/024 187/313
8,220,591 B2 * 7/2012 Atalla ..... B66B 1/20 187/383
8,960,375 B2 2/2015 Katsura
9,120,642 B2 9/2015 Fujihata
9,481,547 B2 * 11/2016 Flynn ..... B66B 1/2458
9,834,405 B2 * 12/2017 Nikovski ..... B66B 1/2458
10,035,679 B2 * 7/2018 Armistead ..... B66B 1/46
2015/0274486 A1 10/2015 Wilke et al.

OTHER PUBLICATIONS

Marja-Liisa Siikonen, "Elevator Group Control with Artificial Intelligence", Helsinki University of Technology, Helsinki, Finland, Oct. 1997, 32 pages.
Thomas Strang et al., "Context-Aware Elevator Scheduling", Feb. 21, 2007, 6 pages.
Peter B. Luh et al., "Group Elevator Scheduling With Advance Information for Normal and Emergency Modes", IEEE Transactions on Automation Science and Engineering, vol. 5, No. 2, Apr. 2008, 14 pages.
Mitsubishi Electric Corporation, "Passenger Elevators (Machine-Room-Less System) Series-IP Version2", Jan. 13, 2016, 11 pages.

* cited by examiner

CONTEXTUAL AWARENESS-BASED ELEVATOR MANAGEMENT

FIELD

Embodiments of the present disclosure generally relate to the field of managing elevator operations. More specifically, embodiments of the present disclosure relate to managing elevator operations using learning processes based on elevator usage patterns and contextual information.

BACKGROUND

In legacy implementations, various processes/algorithms are used to try and configure an elevator system to reduce energy usage and/or reduce wait time. For example there is a process known as the 'elevator algorithm', whereby the elevator is automatically sent in the direction it is travelling until it is summoned in the other direction or until it reaches a defined park position, where the park position is determined to give a best typical response time. Two or more elevators operating in this manner may therefore on average have elevators travelling to or parked in complementary floor positions.

Other legacy processes used may be to predict peaks in up and down traffic dependent on, for example, time of day and bias the elevator floor parking to accommodate the movement trends associated with the time. Other legacy systems may have an elevator passenger use a smartcard to summon an elevator. The system then advises which elevator to take to minimize wait time based on information on other users and elevator positions.

Additional legacy processes are based on early input of floor request for example on entering a building and from this assign one or more passengers to a particular elevator. In this way, riders are clustered for specific floors. However, these legacy processes still require passengers to request their destination floor. Related to this, other legacy technologies have passengers modify their behavior by requesting elevators upon entering a building or have their works pass automatically sensed. Passengers are then directed to an appropriate elevator.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

DETAILED DESCRIPTION

Figure 1:
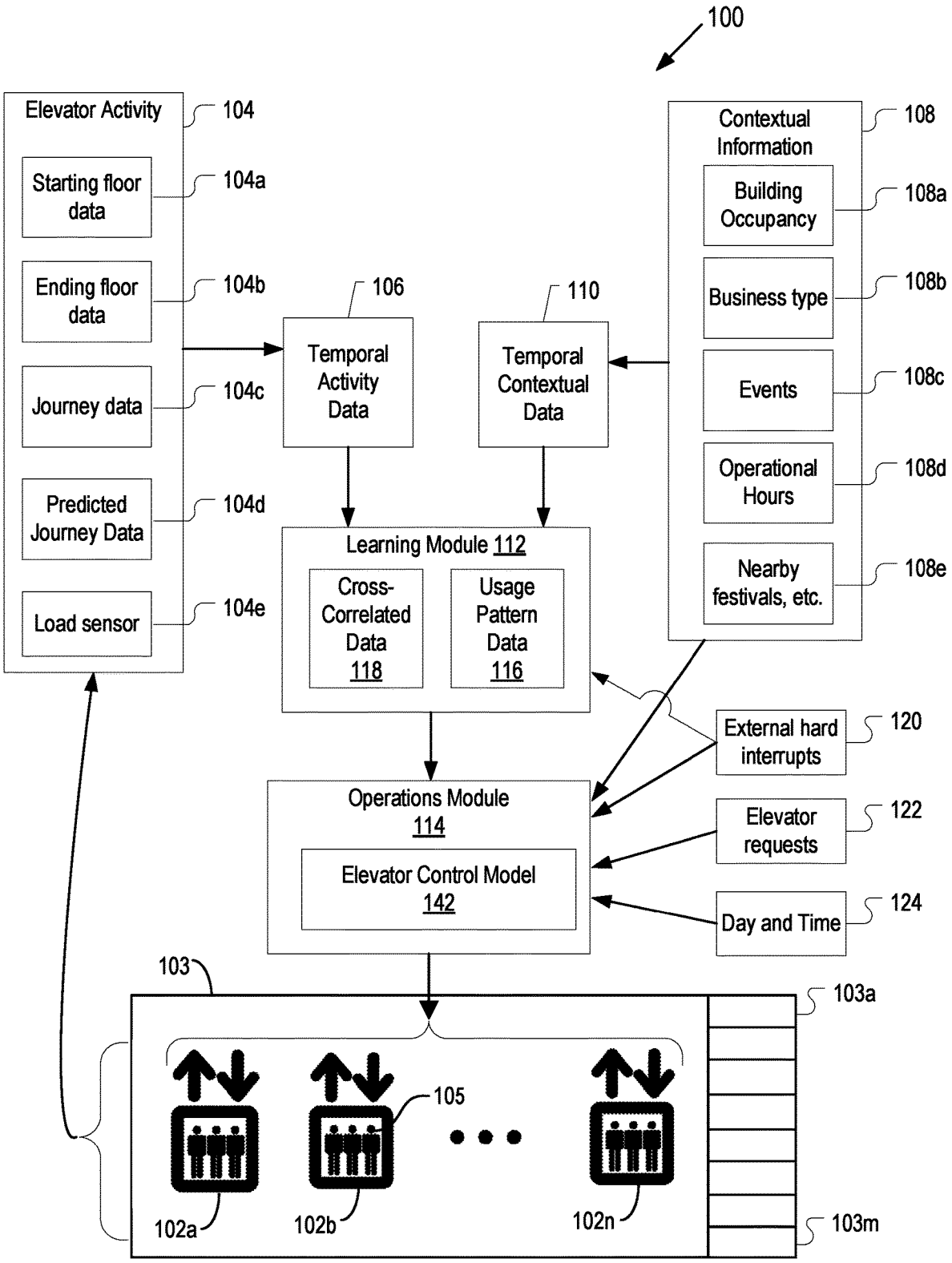
FIG. 1 is a block diagram showing data sources and data flows of a system implementing usage and contextual-based management of elevator operations, in accordance with various embodiments.

Processes, apparatuses, and systems associated with usage and contextual-based management of elevator operations are disclosed herein. Embodiments may provide an improved user experience to reduce aggregate wait times, to reduce energy footprints and lower maintenance schedules and elevator operation costs. Embodiments may also improve building evacuation with elevators that support 911 scenarios. In embodiments, during periods of light elevator traffic, fewer elevators may be needed to maintain an acceptable level of service to users. This may result in decreased operation cost while maintaining an acceptable level of service.

In one embodiment, elevator journeys may be actively monitored and predicted such that during any given period energy usage by an elevator can be reduced without degrading perceived level of service. In embodiments, this perceived level of service maybe defined by wait time.

In embodiments, an elevator control system may have the capability, through learning engines and heuristics, to learn and to constantly adapt to usage patterns on a temporal basis through continuous monitoring of elevator journeys. In embodiments, an elevator journey may include a start and end floor for an individual in a particular elevator. This journey data may be used to predict patterns of usage and may, for example, be used to optimize the number of elevators operational at any time, determine the optimal parking position of each elevator, and/or determine an efficient allocation of elevators to groups or related floors.

In embodiments, learning may also include acquiring contextual information such as special events, proms, hotel conferences, customer visits, public festivals or similar event. This contextual information may include information, outside of information related to elevator operation that may influence elevator use. Contextual information may also include weather conditions or other current events. Contextual information may be proactively input by users or acquired through monitoring by the control system, for example monitoring for prevailing weather conditions.

In embodiments, the elevator control system learns behaviors of mass groups of people through a continuous monitoring of journeys supplemented by temporal and contextual information. In embodiments, although individual elevator use may vary, on average a larger group of individuals will show group behavior patterns that may be dependent on, for example, time of day and with influence from external events. Therefore, it may be possible to predict a usage pattern that applies to the larger group, resulting in improving the overall elevator experience for the group.

Details of these and/or other embodiments, as well as some advantages and benefits, are disclosed and described herein.

In the following description, various aspects of the illustrative implementations are described using terms commonly employed by those skilled in the art to convey the substance of their work to others skilled in the art. However, it will be apparent to those skilled in the art that embodiments of the present disclosure may be practiced with only some of the described aspects. For purposes of explanation, specific numbers, materials, and configurations are set forth in order to provide a thorough understanding of the illustrative implementations. However, it will be apparent to one skilled in the art that embodiments of the present disclosure may be practiced without the specific details. In other instances, well-known features are omitted or simplified in order not to obscure the illustrative implementations.

In the following description, reference is made to the accompanying drawings that form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C).

The description may use perspective-based descriptions such as top/bottom, in/out, over/under, and the like. Such descriptions are merely used to facilitate the discussion and are not intended to restrict the application of embodiments described herein to any particular orientation.

The description may use the phrases "in an embodiment," or "in embodiments," which may each refer to one or more of the same or different embodiments. Furthermore, the terms "including," "having," and the like, as used with respect to embodiments of the present disclosure, are synonymous.

The terms "coupled with" and "coupled to" and the like may be used herein. "Coupled" may mean one or more of the following. "Coupled" may mean that two or more elements are in direct physical or electrical contact. However, "coupled" may also mean that two or more elements indirectly contact each other, but yet still cooperate or interact with each other, and may mean that one or more other elements are coupled or connected between the elements that are said to be coupled with each other. By way of example and not limitation, "coupled" may mean two or more elements or devices are coupled by electrical connections on a printed circuit board such as a motherboard, for example. By way of example and not limitation, "coupled" may mean two or more elements/devices cooperate and/or interact through one or more network linkages such as wired and/or wireless networks. By way of example and not limitation, a computing apparatus may include two or more computing devices "coupled" on a motherboard or by one or more network linkages.

Various embodiments are disclosed that may improve the user experience of elevator passengers in systems servicing multiple floors with multiple elevators by reducing wait time through the application of learning techniques and heuristics to elevator control systems.

In embodiments, elevator control system may be equipped with the capability to monitor elevator usage patterns on a temporal basis and from this learn behavior patterns. As a result, it may predict future usage so that elevator utilization may be optimized to minimize wait times.

In embodiments, the control system may also include contextual awareness to enhance learned behavior patterns with knowledge of external influencing factors such as prevailing weather conditions, events within the locale that are proximate to the elevators being controlled, and knowledge of future contextual influences, such as conventions or public events. Including such input in the learning process may further enhance elevator optimization.

In embodiments, heuristic learning may improve elevator utilization based upon the number of aggregate passengers. For example in periods of low passengers, elevators may be temporarily taken out of service, or be assigned to a very specific usage pattern such as only operating between certain floors. Such improved utilization may save energy and may reduce wear and tear on elevator equipment, lowering maintenance costs.

In embodiments, the elevator control system with contextual awareness and capability of learning usage patterns under such contexts may reduce elevator energy consumption, lower elevator maintenance costs, and maintain or improve the elevator user's experience.

FIG. 1 is a block diagram showing data sources and data flows of a system implementing usage and contextual-based management of elevator operations, in accordance with various embodiments. Diagram 100 shows detail of one embodiment of a system for implementing an example usage and contextual-based management of one or more elevators 102*a* . . . 102*n* that are able to carry multiple people 105 and that operate in a venue 103 that may include multiple floors 103*a* . . . 103*m* serviced by the one or more elevators 102*a* . . . 102*n*.

Elevator activity 104 may be acquired by monitoring elevator usage patterns on a temporal basis to enable learning of usage patterns. Based in part on these patterns decisions can then be made on how to manage elevator operation through the day to, for example, minimize energy consumption and to ensure that wait time between elevator call and elevator arrival and mean transit time to the termination floor, is within acceptable bounds.

In embodiments, elevator activity 104 may aggregate a plurality of activities and events based around the operation of the one or more elevators 102*a* . . . 102*n*. These may include individual elevator journeys taken by a user that may indicate starting floor data 104*a*, ending floor data 104*b* and/or other journey data 104*c*. In turn, predicted journey data 104*d* may be generated, based at least in part on the collected journey data 104*a*-104*c*. In embodiments, other journey data 104*c* may include, in non-limiting examples, activity concerning the starting floor and/or the ending floor of one or more people, floor selections that may have been made prior to entering the elevator or after entering into the elevator, and the time associated with each activity. In embodiments, predicted journey data 104*d* that may include predicted journeys of one or more individuals and whether the actual predicted journey took place may be included. In embodiments, elevator activity 104 may be used to generate temporal activity data 106.

In embodiments, temporal activity data 106 may be generated from elevator activity 104 regarding usage, for example by recording each passenger start floor, end floor and time. From elevator activity 104 a detailed picture of a number of transits between each pair of floors may be built up by the temporal activity data 106 and this information may then be used by the learning module 112 to provide, for example, predictions of peaks and troughs in elevator usage between every pair of floors. In embodiments, this temporal activity data 106 may acquire an enormous amount of data from use over a wide variety of activity that may show general, predictable patterns of usage, even though specific usage may vary significantly on a day-to-day basis. This data may subsequently be used to learn behaviors, and from these behaviors future usage patterns for the operations module 114 to use to optimize elevator management and so reduce wait times, energy footprints and maintenance costs. In embodiments, an elevator control model 142 may be part of the operations module 114.

In embodiments, for example in a multi-story office environment, the learning module 112 may use the temporal activity data 106 that has been received/retrieved to predict periods of peak up traffic during the start of the day and where the highest probability of transit termination would be. As a result, the learning module 112 may provide information to the operations module 114 to make all elevators operative and bias parking of idle elevators to support this upward traffic. In another example, at the end of the day the traffic may be mostly from upper floors to the lower floors so the learning module 112 may determine that certain floors have peak traffic at certain times during that period and bias elevator parking accordingly. In embodiments, the learning module 112 may take into account floor population and work patterns which may vary, for example, by the number and the types of businesses occupying a floor.

In some examples, during other periods of the day elevator activity may indicate starting and ending floors of elevator journeys based on factors other than passengers finishing and starting work. For example, a coffee shop may be on a particular floor, causing elevator patterns to form associated with passengers taking elevators to the coffee shop. In other examples where a single business may occupy multiple floors, some businesses may have increased activity with respect to events that occur on a regular basis on a particular floor, for example package or courier drops to or from that business. These are just a few of the many examples of patterns that may be learned by the learning module 112 over a period of time given temporal elevator activity 106. As a result the learning module 112, in coordination with the operations module 114 may provide optimized elevator routing and/or parking to provide an acceptable service while saving energy and minimizing wear and tear on the elevator equipment.

In embodiments, the learning module 112 in conjunction with the operations module 114 may adaptively assign elevators to service different floors. For example, the learning module 112 may determine that during a certain time period a first group of floors has high demand whereas a second group has low demand. As a result, a first elevator may be assigned to service the first group of floors, a second elevator assigned to the second group of floors and other elevators parked.

In embodiments, the learning module 112 in conjunction with the operations module 114 may predict on which floor increased elevator activity may begin or where the next start floor is likely to be, and proactively move an elevator to this location but do so in a low energy mode, for example to move the elevator slowly to the new position with lights disabled in order to save energy.

In embodiments, the learning module 112 may be enhanced by receiving elevator activity 104 to monitor the number of journeys and to predict the number of users to use the one or more elevators within a given time period rather than by simply monitoring start and end floors. For example, an elevator may use a load monitoring capability to capture load sensor data 104*e* to determine the number of passengers in an elevator at any given time. In embodiments, this could be done by assuming an average weight for a passenger, or by one or more sensors installed in the elevator car. This additional data would then indicate not only the frequency of elevator journeys between any two floors but also the number of users for each elevator journey. In other embodiments, determining the number of passengers in an elevator may be accomplished by using a closed circuit TV system with face detection to count the number of people in the elevator.

This information may be used to for example to assign different capacity elevators to differing journeys, for example a low capacity elevator may consume less energy and may be assigned to the journeys that are predicted to have the lowest passenger count per journey.

In embodiments, contextual information 108 may be collected/received that describes information about events proximate to the one or more elevators 102*a* . . . 102*n* that may influence user demands upon the elevators. Contextual information 108 may include temporal information on external factors which may influence elevator usage. Contextual information 108 may include, but is not limited to, various information such as building occupancy 108*a*, business type 108*b*, events 108*c* including local events such as conferences, proms, shows and the like, operational hours 108*d*, and nearby festivals, etc. 108*e*. In embodiments, contextual information 108 may be further described as any event, occurrence, or attribute outside of the operation of the one or more elevators 102*a* . . . 102*n*. In embodiments, contextual information 108 may be used to generate temporal contextual data 110. In other embodiments, contextual information 108 may serve as direct input to an elevator operation module 114 that may send one or more commands to the one or more elevators 102*a* . . . 102*n*. For example, operational hours 108*d* from the contextual information 108 may provide sufficient information to allow the operations module 114 to park and/or position one or more of the elevators 102*a* . . . 102*n* at the lobby floor at the beginning of operational hours 108*d* to accommodate people coming to work.

In embodiments, predictive algorithms, usage pattern analysis techniques and/or other learning module analysis techniques may benefit from additional contextual data being input. In one non-limiting example, a usage pattern analysis may be influenced by building occupancy 108*a* by floor. In embodiments, this may be monitored by software automatically receiving information from the hotel computer system identifying floor occupancy. As a result, the operations module 114 may bias elevators to floors having higher occupancy. In other embodiments, this may be extended by monitoring which rooms on which floors are occupied by correlating the number of occupied rooms against the number of individual commencements or terminations on that floor. For example, 20 rooms occupied with 10 elevator journey stops and 5 elevator journey starts may indicate that there may be occupants of 15 rooms on the floor. With this information, the learning module 112 can predict the number of people occupying the elevator on each floor and then the operations module 114 may bias the operation to service the floors with the highest predicted occupancy.

Other embodiments may include identifying when a hotel guest has completed a check-in process. This may indicate to the learning module 112 that a journey is likely to be requested from the check-in lobby at a certain time period after check in. The operations module 114 may then send an elevator to that floor so the hotel guest wait is minimized. The delay between check in completion and elevator request may be monitored and predicted, taking into account variations that may be associated with time and or day of the check-in request.

In a further example the usage pattern in hotels may be influenced by external events 108*c*. For example an event and schedules around the event, such as a congress, a conference, or prom may significantly influence elevator usage. Therefore contextual information 108 related to an event 108*c* may include information such as timetable, floor location of event, and the like, and may be aggregated into temporal contextual data 110. This information may then be used, for example by the learning module 112, to predict future usage pattern data 116 or cross-correlated data 118 for similar events. In embodiments, data relating to which floor event participants are located on, which may be available from individual event registration, sub category of event, and the like may be entered into as data. For example, a senior prom may have a different usage pattern as compared to a junior prom. In embodiments, a further refinement of temporal contextual data 110 may include information such as type of conference, the agenda of the conference, age of prom goers, and the like.

In embodiments, the learning module 112 may use information from temporal activity data 106 and from temporal contextual data 110. In embodiments, the learning module 112, may use this data to create usage pattern data 116 and with cross-correlated data 118 to predict elevator usage influenced by external events not related to elevator operation as well as events related to elevator operation In embodiments, the learning module 112 and/or the operational module 114 may take into account external hard interrupts 120. In embodiments, external hard interrupts 120 may include events that may be closely related to interaction of an individual with an elevator. In embodiments, an external hard interrupt 120 may include a hotel guest checking in or an employee swiping a card key upon entering a building lobby. In embodiments, a mean time between the external hard interrupt 120 and an elevator being requested by the operations module 114 may be identified by the learning module 112 and the one of the one or more elevators 102*a* . . . 102*n* may be routed to the user to minimize wait times.

In embodiments, this may be accomplished by using knowledge of the likely end floor for the journey signaled by the interrupt, for example, the hotel guest or employee is likely to go to their room after check in or the employee to their office space after entering the building. Other events like a restaurant table being vacated or a gym exited, etc. may also be used to trigger learning for associated elevator activity.

In embodiments, external hard interrupts 120 may also include events such as a medical emergency, a fire, or some other non-predictable event. In the case of a fire, the elevator control system through monitoring usage patterns via the learning module 112 and other temporal contextual data 110 may predict the optimum evacuation pattern to exit the greatest number of people. This may then be implemented by operations module 114, as discussed further below.

By continually updating elevator activity 104 and contextual information 108, the learning module 112 may continue to learn and refine the predictive usage patterns, and determine the effectiveness of and whether to deploy refined energy minimization strategies and achieve acceptable service levels. In embodiments, through accurate predictions of where the most common elevator journey starts or stops will be on a temporal basis, elevators may be pre-positioned to appropriate floors to minimizing wait time. In addition, journey preference trends between floors or clusters of floors may be more accurately predicted.

In embodiments, the operations module 114 may support operations efficiency as well as reducing aggregate wait time for elevator service. In non-limiting examples, one of the one or more elevators 102*a* . . . 102*n* may be disabled during periods of low usage. In another example, an elevator may be parked on an optimum floor for servicing future passengers based upon predicted usage. In another example, elevators may be placed into a low-energy state during periods of light use.

In embodiments, the operations module 114 and/or the learning module 112 may be used to predict and to support elevator usage requirements in a 911 event. For example the learning module 112 and/or the operations module 114 may track the number of people who may be on any given floor serviced by the one or more elevators 102*a* . . . 102*n*. In embodiments, this may be done by tracking individuals entering or exciting rooms through, for example, door openings, sensors, electronic lock systems, and the like.

In embodiments, in the event of a 911 situation such as a fire, the learning module 112 and/or the operations module 114 may optimize elevator operations to implement an evacuation strategy to evacuate the greatest number of people from the floors in the least amount of time. For example the elevators may be biased to servicing floors with greatest population first or floors assessed as having greatest risk, such as those floors immediately above the floor where the fire is detected.

Figure 2:
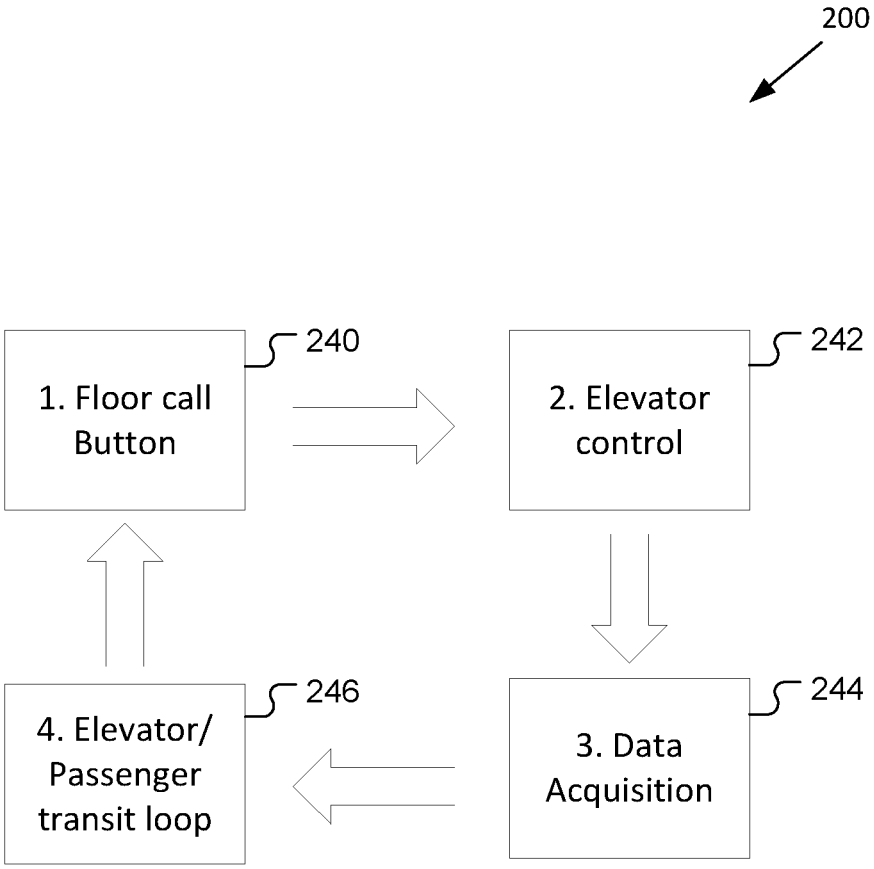
FIG. 2 illustrates a block diagram that shows four major components of the operation of an elevator, in accordance with various embodiments.

FIG. 2 illustrates a block diagram that shows four major phases of the operation of an elevator, in accordance with various embodiments. Diagram 200 illustrates four major phases of the operation for a particular elevator. In a given system there may be N elevators 102*a* . . . 102*n*, as shown in FIG. 1 under coordination of operations module 114. Coordination of the individual elevators may be based on data that has been entered into learning module 112, for example temporal activity data 106 and temporal context will data 110. In embodiments, at any particular time, one or more of the one or more elevators 102*a* . . . 102*n* may be active. In embodiments, one or more of the elevators 102*a* . . . 102*n*, may be inactive or parked.

In embodiments, each of the one or more elevators 102*a* . . . 102*n* may be subject to its own control that is coordinated by the operations module 114, and in particularly the elevator control model 142. In embodiments, elevator operation may be represented by one of four phases. In embodiments, the first phase may be the activation of a floor call button 240 which may be a primary request for an elevator to depart from a given floor.

In embodiments, the second phase may be an elevator control 242, which may be implemented by elevator control model 142 of FIG. 1, that may be part of operations module 114, that may determine to which floors the elevator may transit to and from.

In embodiments, the third phase may be data acquisition 244, which may track and record time stamped elevator use. Data acquisition 244 may include data that is provided to elevator activity 104, and may be subsequently provided to the temporal activity data 106 of FIG. 1 for use by the learning module 112 and the operations module 114. In embodiments, data acquisition may be performed by the operations module 114 or by a third-party device (not shown).

In embodiments, the fourth phase may be the elevator/passenger transit loop 246, which may represent the physical activity of the elevator and passengers transported. In embodiments, the elevator may remain in this closed loop until both the stop and start floor lists are empty. Thereafter, the elevator may enter a stationary or parked status. The transit loop phase may be restarted when a new start floor is assigned, for example by the operations module 114 based on an elevator request 122 or an external hard interrupt 120.

In embodiments, any of the phases may be implemented in, or supported by, the operations module 114.

In embodiments, the floor call button 240 phase may be entered when a user presses a button to call an elevator. This action, a new request, may be captured and recorded as elevator activity 104. The operations module 114 may invoke an elevator control algorithm 142 that may be within the operations module 114, to determine which elevator will service this request. In embodiments, this determination may be made based on the learning module 112 in light of the then current configurations of the one or more elevators 102*a* . . . 102*n*. In embodiments, this learning module 112 may apply heuristic learning and also may take into account the current transit floor assigned to the one or more elevators 102*a* . . . 102*n* to determine appropriate elevator movements.

In a non-limiting example, the operations module 114 may preferentially assign a floor request to an elevator travelling in direction of request. If an elevator is not assigned, then the elevator may take no action in response to the new request. In embodiments, the assigned elevator may have the floor request added to a running list of start (commencement) and/or stop (termination) floors. In embodiments, possible states of an elevator when a new request comes in may be one of active, for example transiting to a floor, or inactive, for example parked. In embodiments this data may be captured through data acquisition 244, and the data included in elevator activity 104 of FIG. 1.

In embodiments, if an elevator that receives a new request is parked, then the operations module 114 may send a command to the elevator to transit to the next floor. In embodiments, the next floor may be determined from the start and stop list for the elevator to which the newly requested floor has been added.

If the elevator is in transit, in embodiments the elevator may be in the elevator/passenger transit loop 246. Transit to a new floor may be determined by the elevator having completed transit to a presently selected floor and passenger embarkation, or disembarkation completed, where there is at least one floor in the start and stop list (the new floor request). The operations module 114 may then begin to move the elevator to the next floor in the start and stop list based on the present direction of travel. If all floors in this direction are exhausted, then the nearest floor in the opposite direction will be selected.

The elevator may then transit to this selected floor. If it is a stop floor, passengers will disembark. If it is a start floor, passengers will embark and may select a new stop floor. The new or predicted stop floor may then be recorded and time stamped and added to elevator activity 104. In embodiments, this information, together with the elevator request, may be used to determine the actual journey. If a new stop floor is requested, this request may be added to the start and stop list. After servicing the floor, the floor may then be deleted from the start and stop list. The termination event may also be time stamped to determine the duration of transit to the floor. In embodiments, this information may be used to further enhance the learning module 112.

Figure 3:
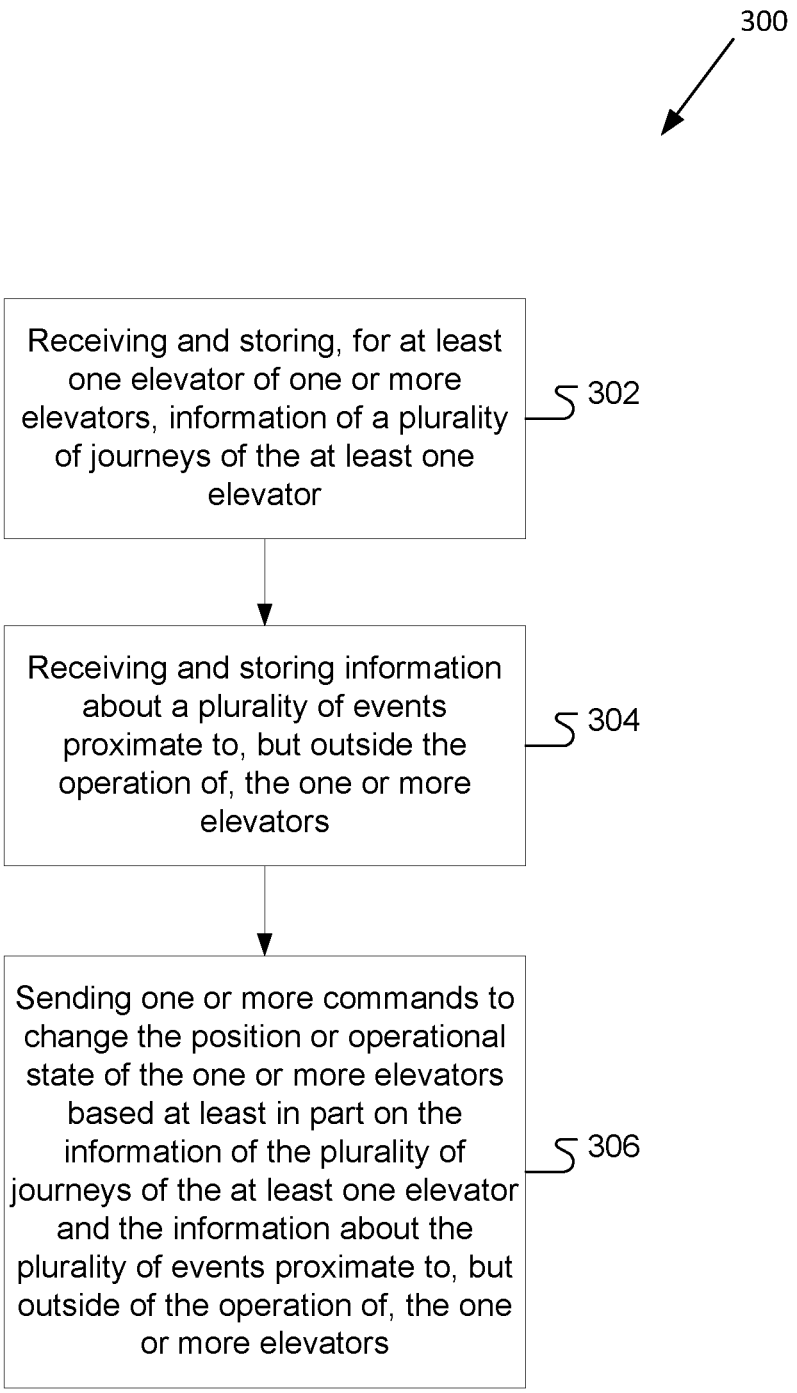
FIG. 3 illustrates a block diagram of a process for implementing a usage and contextual-based management of elevator operations, in accordance with various embodiments.

FIG. 3 is a diagram that shows an example of a flow of the operation of the system, in accordance with various embodiments. In some embodiments, the learning module 112 and/or the operations module 114 of FIG. 1 may perform one or more processes, such as the process 300.

At block 302, the process may include receiving and storing, for at least one elevator of one or more elevators, information of a plurality of journeys of the at least one elevator. In some embodiments, this information may be stored as a part of elevator activity 104 of FIG. 1, and may be gathered by the operations module 114, or by a separate module or device (not shown).

At block 304, the process may include receiving and storing information about a plurality of events proximate to, but outside the operation of, the one or more elevators. In some embodiments, this information will be stored as a part of contextual information 108 of FIG. 1, and may be gathered by a separate module or device (not shown).

At block 306, the process may include sending one or more commands to change the position or operational state of the one or more elevators based at least in part on the information of the plurality of journeys of the at least one elevator and the information about the plurality of events proximate to, but outside of the operation of, the one or more elevators. In some embodiments, data for this process may come from temporal activity data 106, temporal contextual data 110, external hard interrupts 120 elevator requests 122, and/or the date and time 124. In embodiments, the one or more commands may be determined by the learning module 112, which may use usage pattern data 116 and/or cross-correlated data 118, the operations module 114 and/or the elevator control algorithm 142 of FIG. 1.

Figure 4:
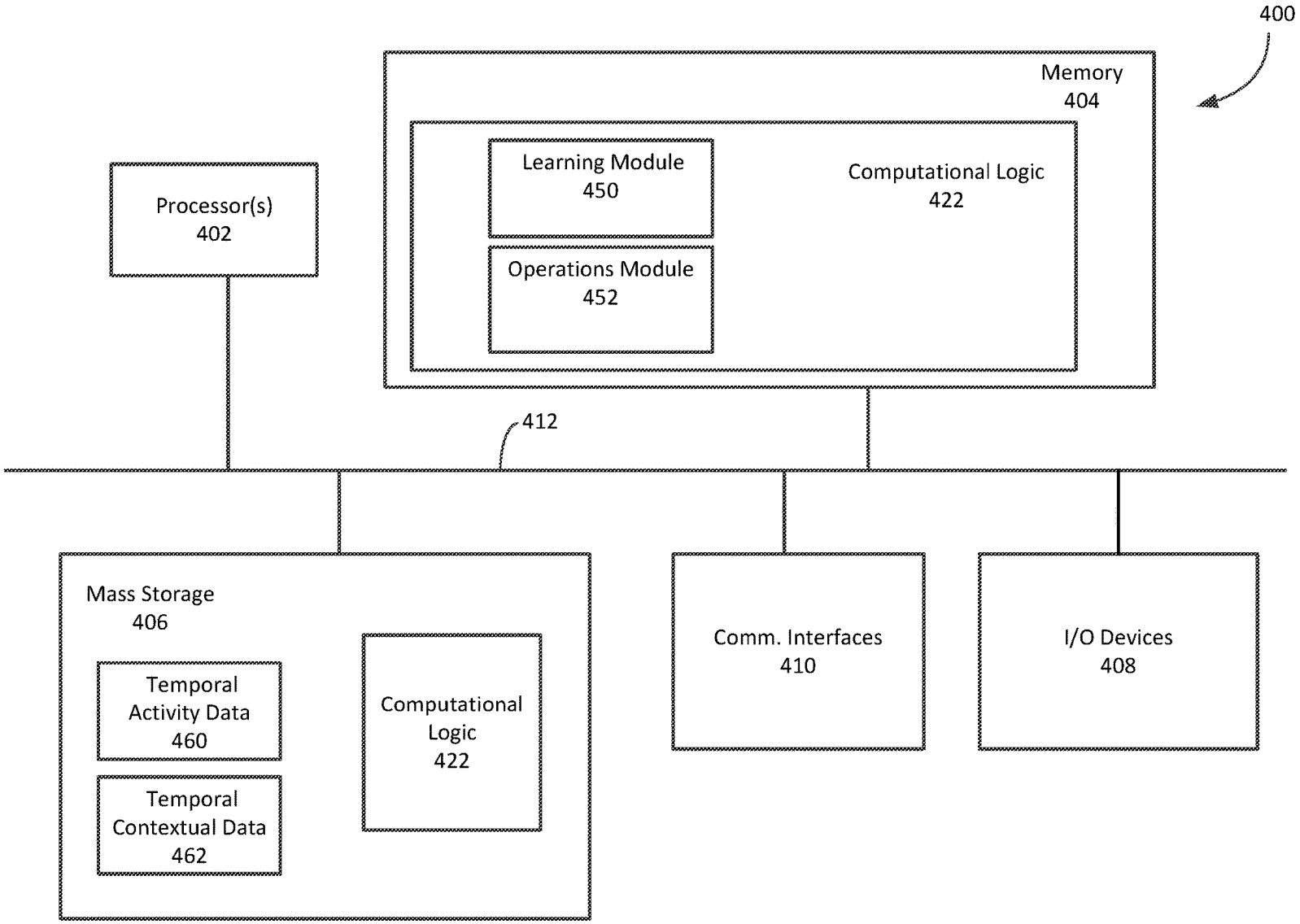
FIG. 4 is a diagram of computing system for implementing a usage and contextual-based management of elevator operations, in accordance with various embodiments.

FIG. 4 illustrates an example computing device 400 suitable for use to practice aspects of the present disclosure, in accordance with various embodiments. For example, the example computing device 400 may be suitable for usage and contextual-based management of elevator operations, and may be used to implement the functionalities associated with diagrams 100, 200, and/or 300.

As shown, computing device 400 may include one or more processors 402, each having one or more processor cores, and system memory 404. The processor 402 may include any type of unicore or multi-core processors. Each processor core may include a central processing unit (CPU), and one or more level of caches. The processor 402 may be implemented as an integrated circuit. The computing device 400 may include mass storage devices 406 (such as diskette, hard drive, volatile memory (e.g., dynamic random access memory (DRAM)), compact disc read only memory (CD-ROM), digital versatile disk (DVD) and so forth). In embodiments, mass storage 406 may include temporal activity data 460, which may be similar to temporal activity data 106 of FIG. 1, and may include temporal contextual data 110 of FIG. 1. In general, system memory 404 and/or mass storage devices 406 may be transitory and/or persistent storage of any type, including, but not limited to, volatile and non-volatile memory, optical, magnetic, and/or solid state mass storage, and so forth. Volatile memory may include, but not be limited to, static and/or dynamic random access memory. Non-volatile memory may include, but not be limited to, electrically erasable programmable read only memory, phase change memory, resistive memory, and so forth.

The computing device 400 may further include input/output (I/O) devices 408 such as a display, keyboard, cursor control, remote control, gaming controller, image capture device, one or more three-dimensional cameras used to capture images, and so forth, and communication interfaces 410 (such as network interface cards, modems, infrared receivers, radio receivers (e.g., Bluetooth), and so forth). I/O devices 408 may be suitable for communicative connections with three-dimensional cameras, elevator sensors, other sensors, or user devices. In some embodiments, I/O devices 408 when used as user devices may include a device necessary for implementing the functionalities of receiving data from elevator activity 104 or from contextual information 108 as described in reference to FIG. 1.

The communication interfaces 410 may include communication chips (not shown) that may be configured to operate the device 400 in accordance with a Global System for Mobile Communication (GSM), General Packet Radio Service (GPRS), Universal Mobile Telecommunications System (UMTS), High Speed Packet Access (HSPA), Evolved HSPA (E-HSPA), or Long Term Evolution (LTE) network. Communication interfaces 410 may also support wired communication including serial communications such as RS-232, or Ethernet. The communication chips may also be configured to operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chips may be configured to operate in accordance with Code Division Multiple Access (CDMA), Time Division Multiple Access (TDMA), Digital Enhanced Cordless Telecommunications (DECT), Evolution-Data Optimized (EV-DO), derivatives thereof, as well as any other wireless protocols that are designated as 3G, 4G, 5G, and beyond. The communication interfaces 410 may operate in accordance with other wireless protocols in other embodiments.

The above-described computing device 400 elements may be coupled to each other via system bus 412, which may represent one or more buses. In the case of multiple buses, they may be bridged by one or more bus bridges (not shown). Each of these elements may perform its conventional functions known in the art. In particular, system memory 404 and mass storage devices 406 may be employed to store a working copy and a permanent copy of the programming instructions implementing the operations and functionalities associated with diagrams 100, 200, and/or 300, generally shown as computational logic 422. Computational logic 422 may be implemented by assembler instructions supported by processor(s) 402 or high-level languages that may be compiled into such instructions.

In embodiments, the Computational Logic 422 may contain a learning module 450, which may be similar to learning module 112 of FIG. 1, which may perform one or more of the functions associated with diagrams 100, 200 and/or 300. Computational Logic 422 may contain an operations module 452, which may be similar to operations module 114 of FIG. 1, which may perform one or more of the functions associated with diagrams 100, 200 and/or 300. In embodiments the operations module 452 may include an elevator control model 142 as shown in FIG. 1.

The permanent copy of the programming instructions may be placed into mass storage devices 406 in the factory, or in the field, though, for example, a distribution medium (not shown), such as a compact disc (CD), or through communication interfaces 410 (from a distribution server (not shown)).

Figure 5:
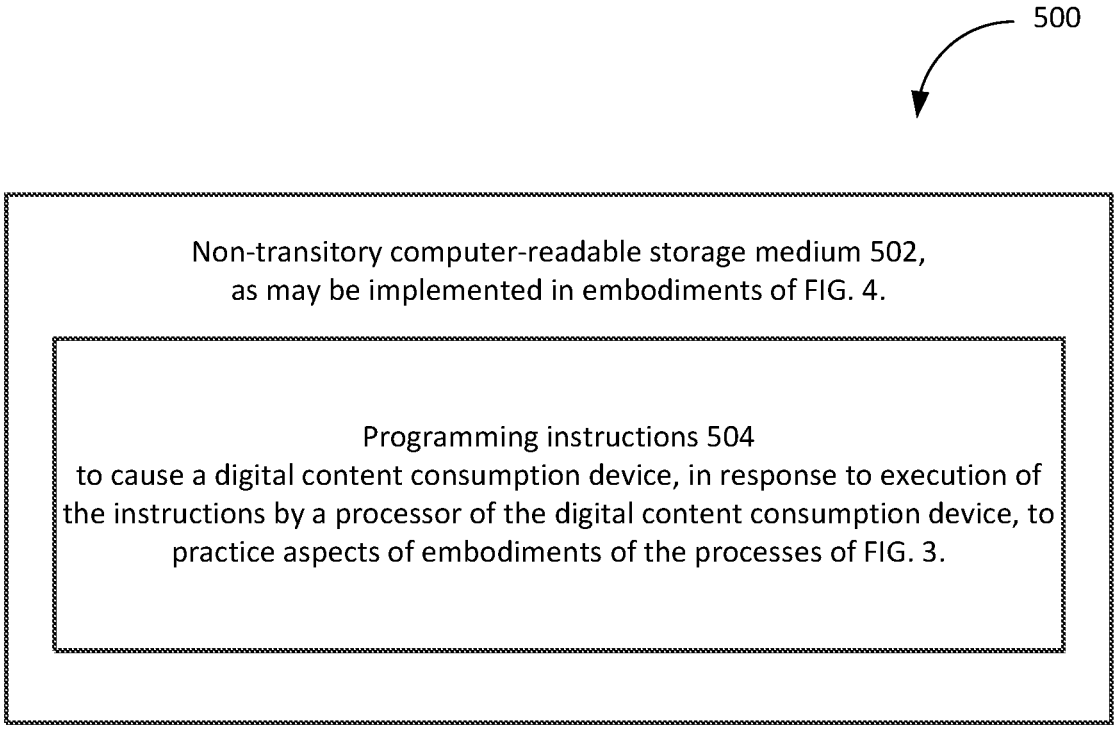
FIG. 5 illustrates a block diagram of a computer readable medium having instructions to implement a usage and contextual-based management of elevator operations, in accordance with various embodiments.

FIG. 5 is a diagram 500 illustrating computer readable media 502 having instructions for practicing the above-described techniques, or for programming/causing systems and devices to perform the above-described techniques, in accordance with various embodiments. In some embodiments, such computer readable media 502 may include programming instructions 504 configured to cause a computer device, e.g., computer device 400, in response to execution of the programming instruction, to perform various aspects of the processes described with references to FIGS. 1-3, e.g, the operations performed by learning module 112 and/or operations module 114. In some embodiments, such computer readable media 502 may be included in a memory or storage device, which may be transitory or non-transitory, of the usage and contextual-based system for operating elevators described in diagram 100 in FIG. 1. In embodiments, instructions 504 may include assembler instructions supported by a processing device, or may include instructions in a high-level language, such as C, that can be compiled into object code executable by the processing device. In some embodiments, a persistent copy of the computer readable instructions 504 may be placed into a persistent storage device in the factory or in the field (through, for example, a machine-accessible distribution medium (not shown)). In some embodiments, a persistent copy of the computer readable instructions 504 may be placed into a persistent storage device through a suitable communication pathway (e.g., from a distribution server).

Various operations are described as multiple discrete operations in turn, in a manner that is most helpful in understanding the claimed subject matter. However, the order of description should not be construed as to imply that these operations are necessarily order dependent.

The foregoing description of one or more implementations provides illustration and description, but is not intended to be exhaustive or to limit the scope of the embodiments to the precise form disclosed or claimed herein. Modifications and variations are possible in light of the above teachings or may be acquired from practice of various implementations of the various embodiments. Future improvements, enhancements, or changes to particular components, processes, or means described in the various embodiments are contemplated to be within the scope of the claims and embodiments described herein, as would readily be understood by a person having ordinary skill in the art.

EXAMPLES

Example 1 may be an apparatus to manage operations of one or more elevators servicing a plurality of floors, the apparatus comprising: one or more computer processors; a usage pattern module coupled with the one or more processors, to identify usage patterns of the one or more elevators, wherein the usage pattern module is to receive and store, for at least one elevator, information of a plurality of journeys; a contextual awareness module coupled with the one or more processors, to identify a context proximate to the one or more elevators, wherein the contextual awareness module is to receive and store information about a plurality of events proximate to, but outside the operation of, the one or more elevators; and an operations module coupled with the one or more processors, to control operation of the one or more elevators, wherein the operations module is to send one or more commands to change a position or an operational state of at least one of the one or more elevators based at least in part on data in the usage pattern data store and in the contextual awareness data store.

Example 2 may include the subject matter of Example 1, wherein the information of the plurality of journeys includes a starting floor, a terminating floor, a start time, and an end time.

Example 3 may include the subject matter of Example 1, further comprising: a learning module coupled with the one or more processors, to assist the operations module to manage the operations of the one or more elevators, wherein the learning module is to apply a heuristic learning engine: receive information from the usage pattern data store and the contextual awareness data store; incorporate the received information into the learning engine; receive a query; and respond to the query; and wherein the operations module is further to: send, to the learning module, a query for a new position or a new operational state for the at least one of the one or more elevators; receive, from the learning module, a response to the query; and generate the one or more commands to change the position or the operational state of the one of the one or more elevators, based at least in part on the response from the learning module.

Example 4 may include the subject matter of Example 3, wherein the operations module is to further receive, prior to sending the query, a current date and time or an identified interrupt.

Example 5 may include the subject matter of Example 4, wherein an identified interrupt includes a guest checking in or an emergency event occurring on one of the plurality of floors.

Example 6 may include the subject matter of Example 5, wherein the emergency event occurring on one of the plurality of floors is a fire on the floor.

Example 7 may include the subject matter of Example 1, wherein information of a plurality of journeys of the usage pattern module comprises the number of passengers in each journey.

Example 8 may include the subject matter of Example 1, wherein the one or more elevators are at a venue; and wherein the plurality of events proximate to, but outside the operation of the one or more elevators include: promotions for the venue, conferences to be held at the venue, customer visits to the venue, public festivals proximate to the venue, a guest checking in at the venue, one or more events at the venue, or weather conditions proximate to the venue.

Example 9 may include the subject matter of Example 1, wherein the contextual awareness module is further to estimate the number of people on at least one of the plurality of floors.

Example 10 may include the subject matter of Example 9, wherein to estimate the number of people on the at least one of the plurality of floors, the contextual awareness module is further to: receive from the usage pattern data store, a number of people getting on or off of the at least one of the plurality of floors over a defined first period of time, or receive an estimate of a number of people on the at least one of the plurality of floors based upon card key activity on the at least one of the plurality of floors over a defined second period of time.

Example 11 may include the subject matter of Example 1, wherein the one or more commands of the operations module comprises one or more commands to: put an elevator into service, take the elevator out of service, direct the elevator to go to a particular floor; restrict the elevator to servicing only a subset of the one or more floors; putting the elevator into service based upon attributes of the elevator, or put the elevator into a low-energy mode.

Example 12 may include the subject matter of any one of Examples 1-11, wherein the apparatus is to reduce elevator passenger wait times in the aggregate.

Example 13 may be a method to manage operations of one or more elevators servicing a plurality of floors, the method comprising: receiving and storing, by a computing system, for at least one elevator of the one or more elevators, information of a plurality of journeys of the at least one elevator; receiving and storing, by the computing system, information about a plurality of events proximate to, but outside the operation of, the one or more elevators; and sending, by the computing system, one or more commands to change the position or operational state of the one or more elevators based at least in part on the information of the plurality of journeys of the at least one elevator and the information about the plurality of events proximate to, but outside of the operation of, the one or more elevators.

Example 14 may include the subject matter of Example 13, further comprising performing machine learning, by the computer system, from the information of a plurality of journeys of the at least one elevator and the information about a plurality of events proximate to, but outside the operation of, the one or more elevators; deriving, by the computer system, a new position or a new operational state for the at least one of the one or more elevators based at least in part on results of the machine learning; and generating and sending the one or more commands to change the position or the operational state of the at least one of the one or more elevators, based on the derived new position or the new operational state for the at least one of the one or more elevators.

Example 15 may include the subject matter of Example 14, wherein performing machine learning further comprises: receiving usage pattern data and contextual information data; incorporating the received information into a learning engine; receiving a query related to the movement of the one or more elevators; and in response to the query, generating and sending an indication of one or more commands to send to the one or more elevators.

Example 16 may include the subject matter of Example 13, wherein the information of a plurality of journeys includes a starting floor, a terminating floor, a start time and an end time.

Example 17 may include the subject matter of any one of Examples 13-16, wherein the method is to reduce elevator passenger wait times in the aggregate.

Example 18 may be one or more computer-readable media comprising instructions that cause a computing device, in response to execution of the instructions by the computing device, to receive and store, by a computing system, for at least one elevator of the one or more elevators, information of a plurality of journeys of the at least one elevator; receive and store, by the computing system, information about a plurality of events proximate to, but outside the operation of, the one or more elevators; and send, by the computing system, one or more commands to change the position or operational state of the one or more elevators based at least in part on the information of the plurality of journeys of the at least one elevator and the information about the plurality of events proximate to, but outside of the operation of, the one or more elevators.

Example 19 may include the subject matter of Example 18, further comprising perform machine learning, by the computer system, from the information of a plurality of journeys of the at least one elevator and the information about a plurality of events proximate to, but outside the operation of, the one or more elevators; derive, by the computer system, a new position or a new operational state for the at least one of the one or more elevators based at least in part on results of the machine learning; and generate and send the one or more commands to change the position or the operational state of the at least one of the one or more elevators, based on the derived new position or the new operational state for the at least one of the one or more elevators.

Example 20 may include the subject matter of Example 18, wherein perform machine learning further comprises: receive usage pattern data and contextual information data; incorporate the received information into a learning engine; receive a query related to the movement of the one or more elevators; and in response to the query, generate and send an indication of one or more commands to send to the one or more elevators.

Example 21 may include the subject matter of Example 18, wherein the information of a plurality of journeys includes a starting floor, a terminating floor, a start time and an end time.

Example 22 may include the subject matter of any one of Examples 18-21, wherein the instructions are to reduce elevator passenger wait times in the aggregate.

Example 23 may be a computing device to manage operations of one or more elevators servicing a plurality of floors, comprising: means for receiving and storing for at least one elevator of the one or more elevators, information of a plurality of journeys of the at least one elevator; means for receiving and storing information about a plurality of events proximate to, but outside the operation of, the one or more elevators; and means for sending one or more commands to change the position or operational state of the one or more elevators based at least in part on the information of the plurality of journeys of the at least one elevator and the information about the plurality of events proximate to, but outside of the operation of, the one or more elevators.

Example 24 may include the subject matter of Example 23, further comprising means for performing machine learning from the information of a plurality of journeys of the at least one elevator and the information about a plurality of events proximate to, but outside the operation of, the one or more elevators; means for deriving a new position or a new operational state for the at least one of the one or more elevators based at least in part on results of the machine learning; and means for generating and sending the one or more commands to change the position or the operational state of the at least one of the one or more elevators, based on the derived new position or the new operational state for the at least one of the one or more elevators.

Example 25 may include the subject matter of Example 24, wherein performing machine learning further comprises: means for receiving usage pattern data and contextual information data; means for incorporating the received information into a learning engine; means for receiving a query related to the movement of the one or more elevators; and in response to the query, means for generating and sending an indication of one or more commands to send to the one or more elevators.

Example 26 may include the subject matter of Example 23, wherein the information of a plurality of journeys includes a starting floor, a terminating floor, a start time and an end time.

Example 27 may include the subject matter of any one of Examples 23-26, wherein the computing device is to reduce elevator passenger wait times in the aggregate.

What is claimed is:

1. An apparatus to manage operations of one or more elevators servicing a plurality of floors at a venue, the apparatus comprising:

one or more computer processors;

a usage pattern module coupled with the one or more processors, to identify usage patterns of the one or more elevators, wherein the usage pattern module is to receive and store, for at least one elevator, information of a plurality of journeys;

a contextual awareness module coupled with the one or more processors, to identify a context indicative of potential usage of the one or more elevators, wherein the contextual awareness module is to receive and store information about a plurality of events proximate to, but outside the operation of, the one or more elevators, wherein the plurality of events includes events at locations outside of, but proximate to the venue; and an operations module coupled with the one or more processors, to control operation of the one or more elevators, wherein the operations module is to send one or more commands to change a position or an operational state of at least one of the one or more elevators based at least in part on data in the usage pattern data store and in the contextual awareness data store.

2. The apparatus of claim 1, wherein the information of the plurality of journeys includes a starting floor, a terminating floor, a start time, and an end time.

3. The apparatus of claim 1, further comprising:

a learning module coupled with the one or more processors, to assist the operations module to manage the operations of the one or more elevators, wherein the learning module is to apply a heuristic learning engine:

receive information from the usage pattern data store and the contextual awareness data store;

incorporate the received information into the learning engine;

wherein the operations module is further to:

generate the one or more commands to change the position or the operational state of the at least one of the one or more elevators, based at least in part on the learning module.

4. The apparatus of claim 3, wherein the operations module is to further receive a current date and time or an identified interrupt.

5. The apparatus of claim 1, wherein information of a plurality of journeys of the usage pattern module comprises a number of passengers in each journey.

6. The apparatus of claim 1, wherein the contextual awareness module is further to estimate a number of people on at least one of the plurality of floors.

7. The apparatus of claim 6, wherein to estimate the number of people on the at least one of the plurality of floors, the contextual awareness module is further to:

receive from the usage pattern data store a number of people getting on or off of the at least one of the plurality of floors over a defined first period of time.

8. The apparatus of claim 1, wherein the one or more commands of the operations module comprises one or more commands to: put an elevator into service, take the elevator out of service, direct the elevator to go to a particular floor, or put the elevator into service based upon attributes of the elevator.

9. The apparatus of claim 1, wherein the apparatus is to reduce elevator passenger wait times in the aggregate.

10. A method to manage operations of one or more elevators servicing a plurality of floors, the method comprising:

receiving and storing, by a computing system, for at least one elevator of the one or more elevators, information of a plurality of journeys of the at least one elevator;

receiving and storing, by the computing system, information about a plurality of events proximate to, but at locations outside the operation of, a venue that includes the one or more elevators, wherein the plurality of events includes events at locations outside of, but proximate to, the venue; and sending, by the computing system, one or more commands to change a position or an operational state of the one or more elevators based at least in part on the information of the plurality of journeys of the at least one elevator and the information about the plurality of events proximate to, but outside of the operation of, the one or more elevators.

11. The method of claim 10, further comprising:

performing machine learning, by the computing system, from the information of the plurality of journeys of the at least one elevator and the information about the plurality of events proximate to, but outside the operation of, the one or more elevators;

deriving, by the computing system, a new position or a new operational state for the at least one of the one or more elevators based at least in part on results of the machine learning; and generating and sending the one or more commands to change the position or the operational state of the at least one of the one or more elevators, based on the derived new position or the new operational state for the at least one of the one or more elevators.

12. The method of claim 10, wherein the information of the plurality of journeys includes a starting floor, a terminating floor, a start time and an end time.

13. The method of claim 10, wherein the method is to reduce elevator passenger wait times in the aggregate.

14. One or more computer-readable media comprising instructions that cause a computing device, in response to execution of the instructions by the computing device, to receive and store, by a computing system, for at least one elevator of the one or more elevators, information of a plurality of journeys of the at least one elevator;

receive and store, by the computing system, information about a plurality of events proximate to, but at locations outside the operation of, a venue that includes the one or more elevators, wherein the plurality of events includes events at locations outside of, but proximate to, the venue; and send, by the computing system, one or more commands to change a position or an operational state of the one or more elevators based at least in part on the information of the plurality of journeys of the at least one elevator and the information about the plurality of events proximate to, but outside of the operation of, the one or more elevators.

15. The one or more computer-readable media of claim 14, further comprising:

perform machine learning, by the computing system, from the information of the plurality of journeys of the at least one elevator and the information about the plurality of events proximate to, but outside the operation of, the one or more elevators;

derive, by the computing system, a new position or a new operational state for the at least one of the one or more elevators based at least in part on results of the machine learning; and generate and send the one or more commands to change the position or the operational state of the at least one of the one or more elevators, based on the derived new position or the new operational state for the at least one of the one or more elevators.

16. The one or more computer readable media of claim 14, wherein the information of a plurality of journeys includes a starting floor, a terminating floor, a start time and an end time.

17. The one or more computer readable media of claim 14, wherein the instructions are to reduce elevator passenger wait times in the aggregate.

18. A computing device to manage operations of one or more elevators servicing a plurality of floors, comprising:

means for receiving and storing, for at least one elevator of the one or more elevators, information of a plurality of journeys of the at least one elevator;

means for receiving and storing, information about a plurality of events proximate to, but outside the operation of, a venue that includes the one or more elevators, wherein the plurality of events includes events at locations outside of, but proximate to, the venue; and means for sending one or more commands to change a position or an operational state of the one or more elevators based at least in part on the information of the plurality of journeys of the at least one elevator and the information about the plurality of events proximate to, but outside of the operation of, the one or more elevators.

19. The computing device of claim 18, further comprising:

means for performing machine learning from the information of the plurality of journeys of the at least one elevator and the information about the plurality of events proximate to, but outside the operation of, the one or more elevators;

means for deriving a new position or a new operational state for the at least one of the one or more elevators based at least in part on results of the machine learning; and means for generating and sending the one or more commands to change the position or the operational state of the at least one of the one or more elevators, based on the derived new position or the new operational state for the at least one of the one or more elevators.

* * * * *